US007406727B2

(12) United States Patent
Wickstrom et al.

(10) Patent No.: US 7,406,727 B2
(45) Date of Patent: Aug. 5, 2008

(54) FOLDABLE FOUNDATION FOR A MATTRESS

(75) Inventors: Brenda Wickstrom, Carthage, MO (US); Niels Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 247 days.

(21) Appl. No.: 11/026,939

(22) Filed: Dec. 30, 2004

(65) Prior Publication Data

US 2005/0251911 A1 Nov. 17, 2005

Related U.S. Application Data

(63) Continuation-in-part of application No. 10/842,820, filed on May 11, 2004.

(51) Int. Cl.
*A47C 19/12* (2006.01)

(52) U.S. Cl. ..... 5/174; 5/12.2; 5/13

(58) Field of Classification Search ..... None
See application file for complete search history.

(56) References Cited

U.S. PATENT DOCUMENTS

| | | | | |
|---|---|---|---|---|
| 4,377,279 | A | 3/1983 | Schulz, Jr. et al. | 267/103 |
| 4,489,450 | A | 12/1984 | Miller | 5/250 |
| 4,620,336 | A | 11/1986 | Miller | 5/249 |
| 4,654,905 | A | 4/1987 | Miller | 5/249 |
| 4,704,752 | A | 11/1987 | Yates et al. | 5/247 |
| 4,770,397 | A | 9/1988 | Schulz, Jr. | 267/144 |
| 4,771,995 | A | 9/1988 | Wells et al. | 267/103 |
| 4,903,949 | A | 2/1990 | Schulz, Jr. | 267/103 |
| 5,346,188 | A | 9/1994 | Rodgers et al. | 267/106 |
| 5,551,104 | A | 9/1996 | Hartline | 5/13 |
| 5,622,357 | A | 4/1997 | Schulz, Jr. et al. | 267/103 |
| 5,765,240 | A | 6/1998 | Workman | 5/247 |
| 5,894,614 | A * | 4/1999 | Stroud | 5/200.1 |
| 6,012,190 | A | 1/2000 | Rogers | 5/722 |
| 6,032,307 | A | 3/2000 | Workman | 5/247 |
| 6,216,289 | B1 * | 4/2001 | Woods | 5/200.1 |
| 6,588,035 | B2 * | 7/2003 | Le Duc et al. | 5/247 |
| 6,651,276 | B2 | 11/2003 | McCraw et al. | 5/246 |
| 7,100,989 | B2 * | 9/2006 | Andersson et al. | 297/378.13 |

* cited by examiner

*Primary Examiner*—Tara L. Mayo
(74) *Attorney, Agent, or Firm*—Wood, Herron & Evans, LLP

(57) ABSTRACT

A foldable bedding foundation comprising a first section is hingedly secured to a second section so that the bedding foundation may be folded for storage or transportation purposes. Each section has base, a plurality of wire struts pivotally secured to the base, an upper wire grid pivotally secured to the wire struts and braces extending between the base and an outermost wire strut. A lower hinge comprising a piece of wire having a square wave shape is secured to and extends between the bases. An upper hinge is secured to and extends between border wires of the sections. A support assembly is secured to and extends between the first and second sections.

19 Claims, 6 Drawing Sheets

FOLDABLE FOUNDATION FOR A MATTRESS

CROSS REFERENCE TO RELATED APPLICATIONS

This application is a continuation-in-part of U.S. patent application Ser. No. 10/842,820, filed May 11, 2004, entitled "Foldable Bedding Foundation," which is hereby incorporated by reference herein in its entirety.

FIELD OF THE INVENTION

This invention relates generally to bedding foundations and more particularly to a bedding foundation which is collapsible for storage and shipment.

BACKGROUND OF THE INVENTION

Conventional bedding foundations such as box springs typically include an array or matrix of springs, a wooden base and an upper grid including a generally rectangular border wire. The springs may be coil springs or modular springs. The components are commonly shipped from a spring manufacturer to a box spring manufacturer separately. Once the components arrive at the box spring manufacturer's facility, the box spring manufacturer attaches the lower ends of the springs which extend downwardly from an upper wire grid assembly to a base. Padding and a cover is applied by the box spring manufacturer as desired. Such conventional bedding foundations are large and cumbersome to handle in storage, transportation or shipment which, of course, increases the ultimate cost.

Moreover, it is not uncommon for a coil spring manufacturer to compress or deform coil springs units layered one on top of the other into condensed or compacted multilayered packs for shipment to a box spring manufacturer. The aforementioned step is performed by means of a press machine enabling the foundation units to be compressed to reduce their height dimension. The coil spring units of each pack are held in their compacted state against return to their normal or unstressed condition by means of strapping applied about the unit. The spring units of each pack being compressed, the strapping is under a great amount of tension. When the packs arrive at the place of the manufacturer, it is, of course, necessary to sever the strapping around the packs in order to release the spring units for installation into box springs or mattresses. This, of course, is difficult because of the high degree of tension to which the strapping is subjected by the compression of the coil springs.

U.S. Pat. No. 4,377,279 discloses a wire foundation unit for a box spring which may be shipped to a box spring manufacturer in a collapsed condition. The manufacturer would erect the foundation wires and then fix by staples, rigid struts between the wire unit and base to permanently secure the wire unit in the erected position. The box spring manufacturing process is completed by providing the conventional layer of padding on the top of the wire foundation and a sheet covering or casing about the entire unit. However, once the manufacture is completed, the box spring is no longer collapsible and thus must be shipped in its expanded or full-size state to the point of retail or use whereby the same storage and shipment costs result at this point as with conventional box springs.

U.S. Pat. No. 4,654,905 discloses another collapsible bedding foundation for a box spring which can be shipped to a box spring manufacturer in a collapsed condition. The box spring manufacturer would erect the collapsed bedding foundation before applying padding on the top of the erected bedding foundation and covering or casing the entire unit. The collapsible bedding foundation disclosed in this patent utilizes a hinge to connect two sections of the bedding foundation so that, when collapsed, one section may overlay the other section. One drawback to this bedding foundation is that the hinge is expensive, thereby adding substantial cost to the manufacturer of the collapsible bedding foundation which is in turn passed on to the manufacturer of the box spring.

Another problem with collapsible bedding foundations, such as that of U.S. Pat. No. 4,654,905, is a reduced amount of support between the first and second sections of the foundation that are foldable relative to one another. For example, standard non-foldable bedding foundations include a solid one-piece base, such as a substantially rectangular wood frame, which provides support throughout the entire structure of the bedding foundation. However, bedding foundations that are foldable include at least two frames, one for each of the two sections of the foundation. As a result, an area including a "gap" is formed between the two sections of the foundation. This gap is not necessarily a discernable space (although it may be), but is the area between the portions of the first and second sections which confront one another. The gap may represent a point of weakness between the two sections, which may be discernable to a user of the bedding foundation, or may serve as a point for collapse of the bedding foundation following repeated use. This reduced support affects the center of the bedding foundation, as well as the stability of the unit as a whole.

Therefore, there is a need for a collapsible box spring which is less expensive to manufacture than known collapsible box springs. There is further a need for an affordable box spring which may be collapsed after being upholstered. And there is a further need for a box spring that is collapsible while still providing adequate support to a user, particularly at or near the gap between the two sections of the box spring.

SUMMARY OF THE INVENTION

The bedding foundation of the present invention comprises two sections which are hingedly secured together with upper and lower hinges. A support assembly is secured to the two sections to prevent any "give" in the center of the unit when the unit is in an extended or erected position. Further, the support assembly may extend between the two sections to bridge any gap between the two sections, thereby preventing any "give" in the center of the unit when the unit is in an extended or erected position. Each section comprises a plurality of wire struts or support members movable between a retracted or collapsed position and an extended or erected position. In their retracted positions, the support members are generally unstressed and lie in generally horizontal planes. Thus, the bedding foundation is substantially reduced in its depth dimension thereby facilitating storage handling and/or shipment at reduced unit cost. In their extended positions, the support members are erect in generally vertical planes and thus, the bedding foundation is ready for use. After use, the bedding foundation may be collapsed to its storage position and then later expanded to its use or erected position. This process by be repeated as often as desired.

In one embodiment, the bedding foundation or body support is constructed to be foldable upon itself into two overlying sections, thus reducing the length approximately in half for storage. This action is also used to actuate the support members from their erected positions into their retracted positions. Unfolding of the bedding foundation sections to place them into a coplanar position moves the support members from their retracted position to their erect position for providing support for the body when in use.

The two sections of the bedding foundation are joined with an upper hinge and a lower hinge. The lower hinge is secured to the bases of the sections and extends therebetween. In one embodiment of the present invention, the lower hinge is a wire assuming a square wave form. Other types of lower hinges may be used in accordance with the present invention. The upper hinge is secured to the wire grid of each section and extends therebetween. In one embodiment of the present invention, the upper hinge comprises a pair of spaced connectors. The connectors provide spacing between the border wires of the upper grids of the foundation sections which facilitates folding of the foundation, even when fully upholstered. However, other types of upper hinges may be used in accordance with the present invention such as a helical connector, for example.

Each section of the foundation may include two braces which maintain the wire struts or support members in a generally vertical orientation when the bedding foundation is in its erected position or condition. The braces provide stability to the foundation when the bedding foundation is erect and a load placed thereon. Each of these braces is generally V-shaped and has a pair of arms extending outwardly from a bottom portion which is stapled or otherwise secured to one of the cross rails of the base of one of the foundation sections. Each arm of the brace terminates in an arcuate portion which is slidably engaged with an outermost wire strut of the section. The braces move between an upper position when the bedding foundation is in its erected position and a lower position when the bedding foundation is in its collapsed position. Other numbers or configurations of braces may be used in accordance with the present invention.

As described briefly above, the bedding foundation further includes a support assembly that is operatively connected to the two sections of the foundation. This support assembly provides additional support to the center of the unit, to prevent any "give" that may occur at the gap between the two sections. In one embodiment, this support assembly is generally an L-bracket. The bracket includes orifices that align with orifices in the wood frames of each section of the bedding foundation. A support connector, such as a T-nut, is disposed in each orifice of the wood frames. And the support assembly is attached to the foundation by disposing a portion of legs of the foundation through the orifices of the L-bracket and into the wood frame. This is generally accomplished with a threaded extension on the end of each leg, which is compatible with threads of the T-nuts disposed in the orifices of the wood frames. Thus, one end of the L-bracket is attached to a first section of the foundation, and the other end of the L-bracket is attached to the second section of the foundation.

BRIEF DESCRIPTION OF THE DRAWINGS

These objectives and features of the invention will become more readily apparent from the following detailed description taken in conjunction with the accompanying drawings in which.

DETAILED DESCRIPTION OF THE INVENTION

Figure 1:
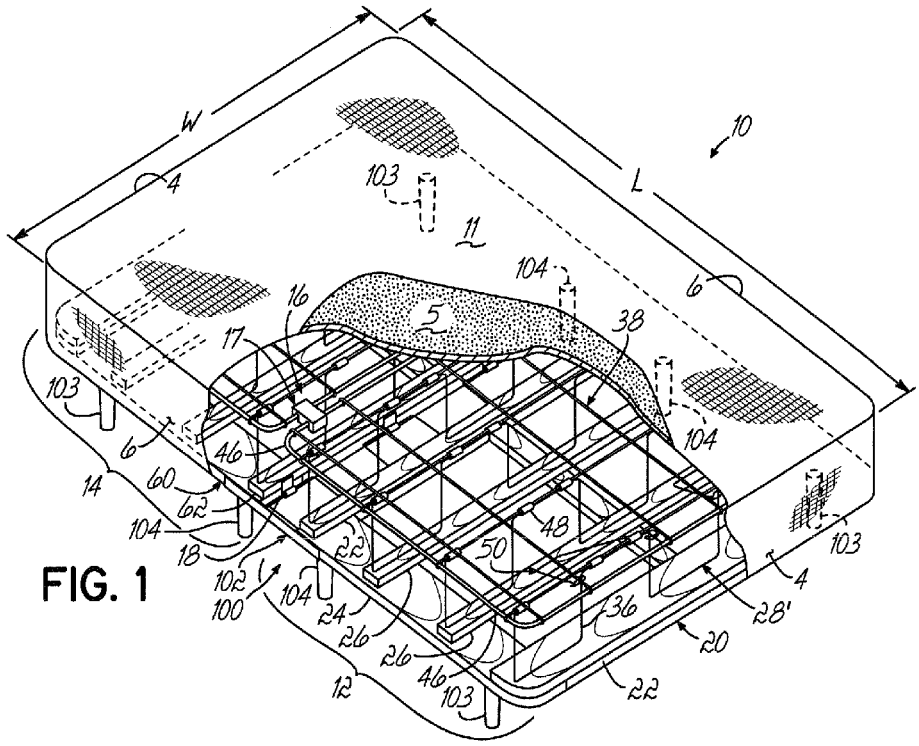
FIG. 1 is a perspective view of one embodiment of the collapsible bedding foundation of the present invention in an erected condition.
Figure 4:
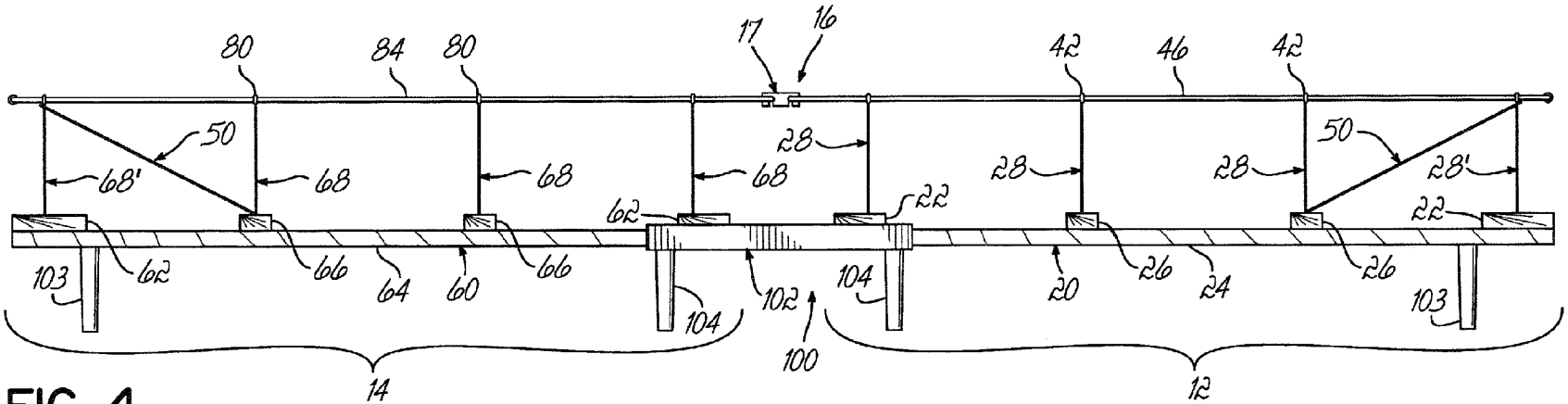
FIG. 4 is a side elevational view of the collapsible bedding foundation of FIG. 1 without a cover in an erected condition.
Figure 5:
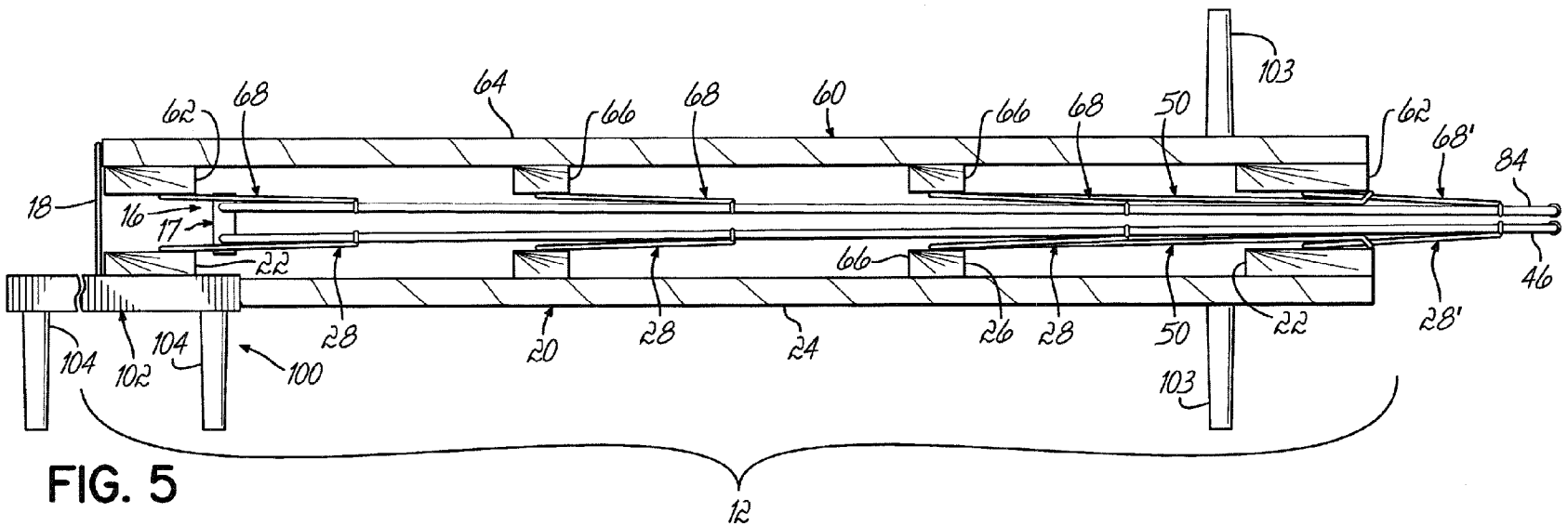
FIG. 5 is a side elevational view of the collapsible bedding foundation of FIG. 1 without a cover in a collapsed condition.

Referring to the drawings, and particularly to FIG. 1, there is illustrated a foldable or collapsible bedding foundation 10. The bedding foundation 10 has a pair of end surfaces 4 defining a length or longitudinal dimension L of the foundation 10 and a pair of opposed side surfaces 6 defining a width W of the foundation 10. The bedding foundation 10 has a first section 12 hinged to a second section 14 with an upper hinge 16 and lower hinge 18. See FIG. 5. The hinges 16, 18 enable the bedding foundation 10 to move from an erected position shown in FIGS. 1 and 4 to a collapsed position shown in FIG. 5. Although FIGS. 4 and 5 illustrate the bedding foundation 10 with no cover, the bedding foundation 10 may be collapsed with a surrounding cover 11 as shown in FIG. 1. If desired, padding 5 may be placed on the upper surface of the bedding product 10 before the surrounding cover 11 is attached.

Figure 2:
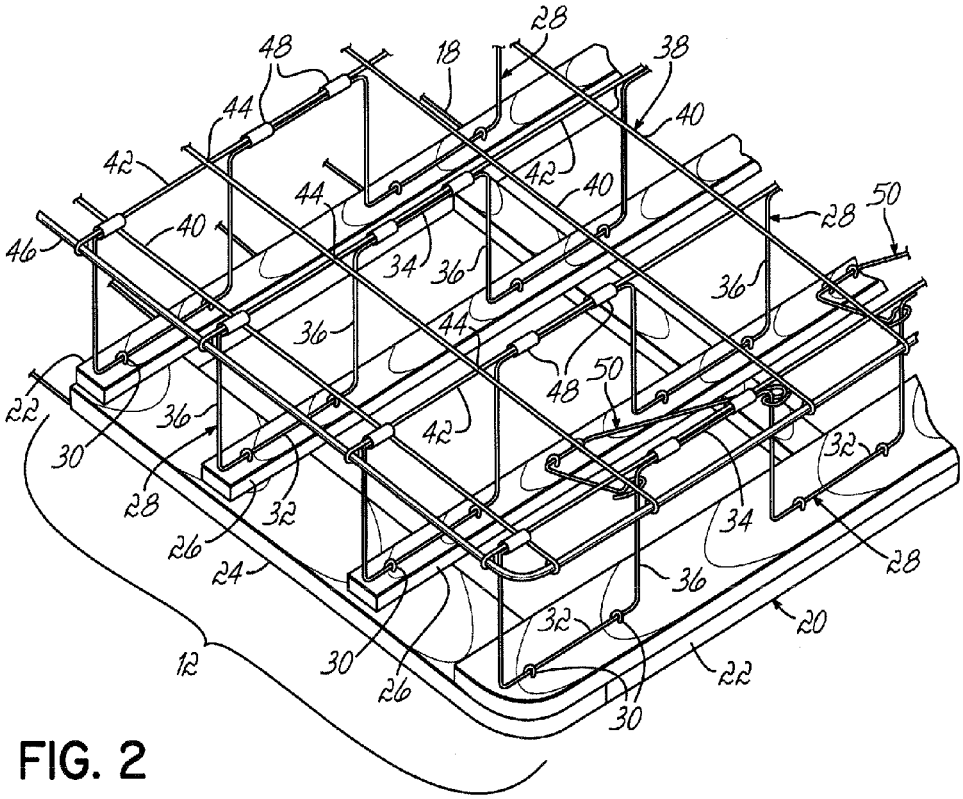
FIG. 2 is an enlarged perspective view of a portion of the first section of the collapsible bedding foundation of FIG. 1.
Figure 3:
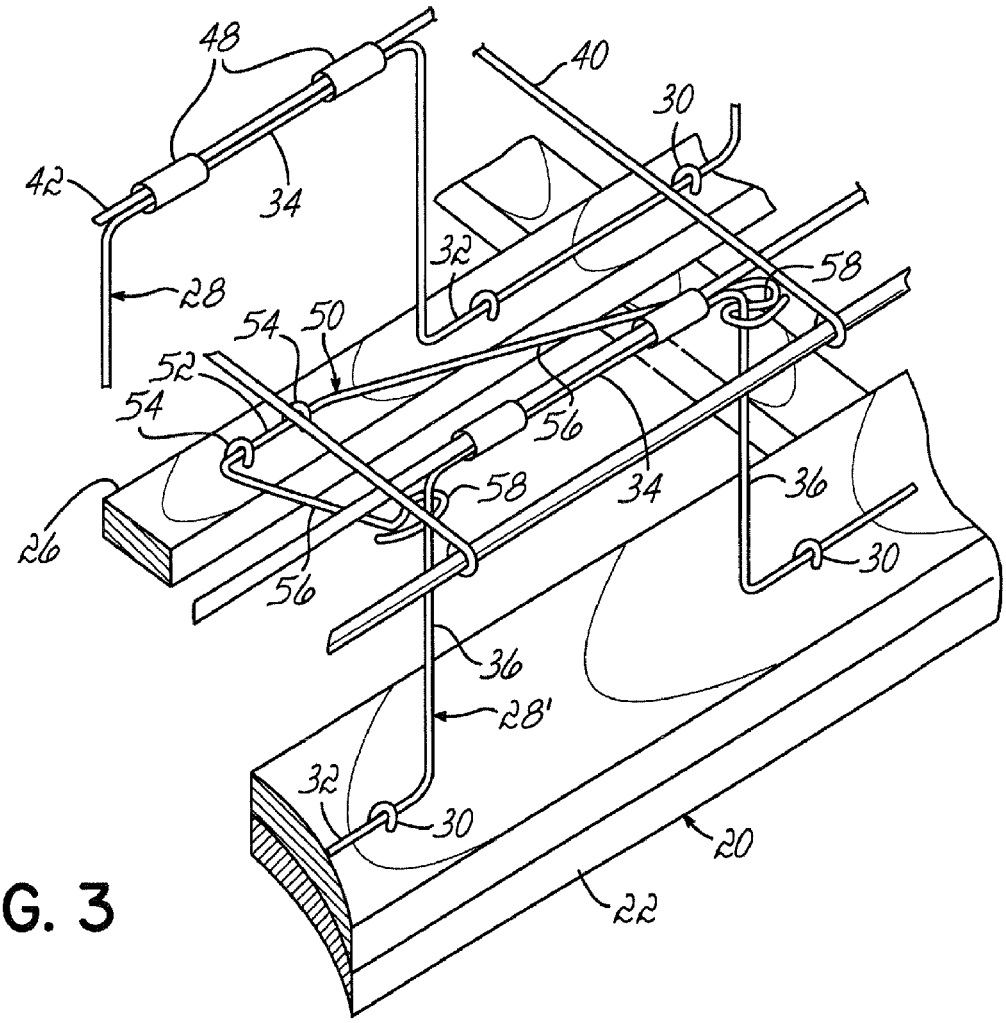
FIG. 3 is an enlarged perspective view of a portion of the first section of the collapsible bedding foundation of FIG. 1 illustrating one brace in detail.

Referring to FIGS. 1 and 2, the first section 12 comprises a first base 20 having a pair of opposed end rails 22, a pair of opposed siderails 24 and a plurality of cross rails 26, as is conventional. As shown in FIGS. 2 and 3, a plurality of first wire struts or body supports 28 are pivotally secured to the cross rails 26 and end rails 22 of the first base 20 with staples 30. Each wire strut 28 has a square wave shape including a plurality of spaced lower portions 32 which are co-linear and a plurality of spaced upper portions 34 which are co-linear. The upper and lower portions 34, 32 are joined with spaced, parallel connecting portions 36. The lower portions 32 of each wire strut 28 are stapled to the cross rails 26 and end rails 22 of the first base 20 with staples 30 so the wire strut 28 may pivot relative to the first base 20. When the bedding foundation 10 is in its erected condition or position as shown in FIGS. 1 and 4, the connecting portions 36 of the wire struts 28 are vertically oriented and the upper and lower portions 34, 32 of the wire struts 28 are horizontally oriented.

The first section 12 of the collapsible bedding foundation 10 further comprises a first upper grid 38 comprising a plurality of spaced, parallel longitudinal grid wires 40 and a plurality of spaced, parallel transverse grid wires 42 intersecting with and secured to the longitudinal grid wires 40 at intersections 44. A generally rectangular border wire 46 surrounds the longitudinal grid wires 40 and transverse grid wires 42 and forms a part of the upper grid 38. The ends of the longitudinal grid wires 40 and transverse grid wires 42 are wrapped around, welded or otherwise secured to the border wire 46, as is conventional.

As best seen in FIG. 2, the upper portions 34 of each wire strut 28 are pivotally secured to the transverse grid wires 42 of the first upper grid 38 with metal clips 48 so the wire strut 28 may pivot relative to the first upper grid 38. Securing devices other than metal clips such as plastic clips or helical lacing wires may used if desired to pivotally secure the upper portions 34 of the wire struts 28 to the transverse grid wires 42 of the first upper grid 38. As best shown in FIG. 3, although two metal clips 48 are illustrated securing each different upper portion 34 of each wire strut 28 to a transverse grid wire 42, any number of metal clips 48 may be used to do so.

As shown in FIGS. 1, 2 and 3, a pair of braces 50 extend between one of the cross rails 26 of the first base 20 and an outermost wire strut 28' of the first section 12 of the bedding foundation 10. As best illustrated in FIG. 3, each brace 50 comprises a linear bottom portion 52 pivotally secured to the cross rail 26 with staples 54 and a pair of arms 56 extending outwardly from opposed ends of the bottom portion 52 of the brace 50. Each arm 56 terminates in an end portion 58 which comprises an arched or arcuate wire wrapped around one of the connecting portions 36 of the outermost wire strut 28'. As the bedding foundation 10 is collapsed from its erected position shown in FIG. 4 to its collapsed position shown in FIG. 5, the end portions 58 of the braces 50 slide down the connecting portions 36 of the outermost wire strut 28' until they come to rest in a substantially horizontal orientation as shown in FIG. 5.

Figure 2A:
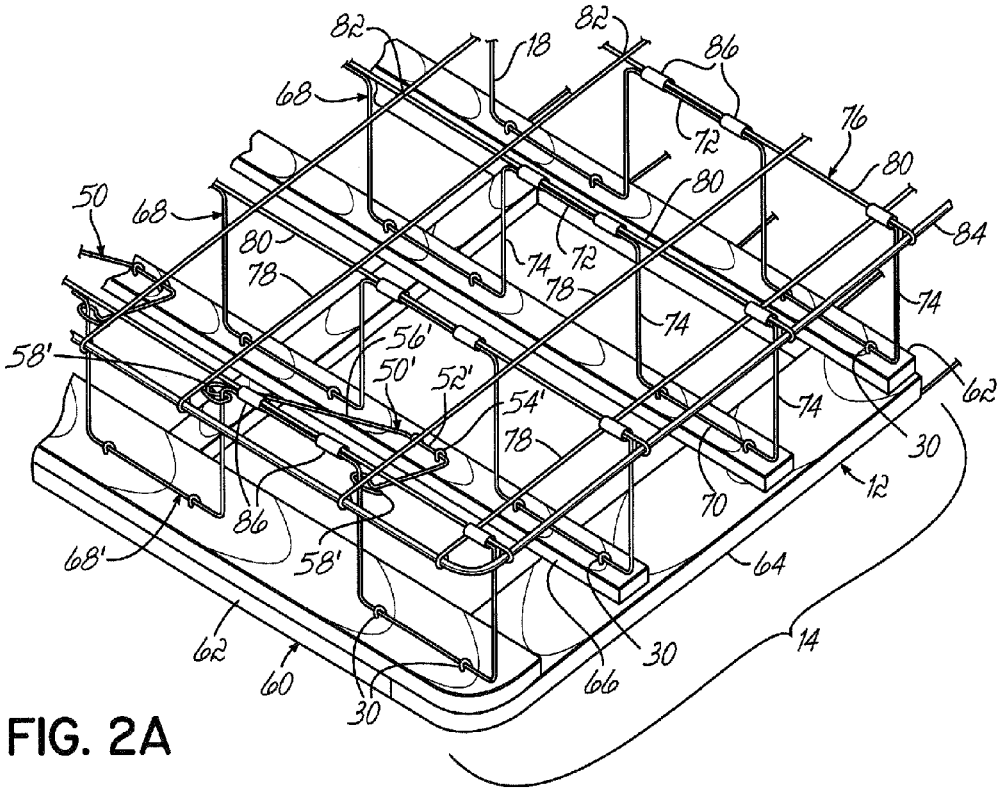
FIG. 2A is an enlarged perspective view of a portion of the second section of the collapsible bedding foundation of FIG. 1.

Referring to FIGS. 1 and 2A, the second section 14 of the bedding foundation 10 comprises a second base 60 having a pair of opposed end rails 62, a pair of opposed siderails 64 and a plurality of cross rails 66, as is conventional. As shown in FIG. 2A, a plurality of second wire struts or body supports 68 are pivotally secured to the cross rails 66 and end rails 62 of the second base 60 with staples 30. Each wire strut 68 has a square wave shape including a plurality of spaced lower portions 70 which are co-linear and a plurality of spaced upper portions 72 which are co-linear. The upper and lower portions 72, 70 are joined with spaced, parallel connecting portions 74. The lower portions 70 of each wire strut 68 are stapled to the cross rails 66 and end rails 62 of the second base 60 with staples 30 so the wire strut 68 may pivot relative to the second base 60. When the bedding foundation 10 is in its erected condition or position as shown in FIGS. 1 and 4, the connecting portions 74 of the wire struts 68 are vertically oriented and the upper and lower portions 72, 70 of the wire struts 68 are horizontally oriented.

Referring to FIG. 2A, the second section 14 of the collapsible bedding foundation 10 further comprises a second upper grid 76 comprising a plurality of spaced, parallel longitudinal grid wires 78 and a plurality of spaced, parallel transverse grid wires 80 intersecting with and secured to the longitudinal grid wires 78 at intersections 82. A generally rectangular border wire 84 surrounds the longitudinal grid wires 78 and transverse grid wires 80 and forms a part of the upper grid 76. The ends of the longitudinal grid wires 78 and transverse grid wires 80 are wrapped around, welded or otherwise secured to the border wire 84, as is conventional.

The upper portions 72 of each wire strut 68 are pivotally secured to the transverse grid wires 80 of the second upper grid 76 with metal clips 86 so the wire strut 68 may pivot relative to the second upper grid 76. Securing devices other than metal clips such as plastic clips or helical lacing wires may used if desired to pivotally secure the upper portions 72 of the wire struts 68 to the transverse grid wires 80 of the second upper grid 76. As best shown in FIG. 3, although two metal clips 86 are illustrated securing each different upper portion 72 of each wire strut 68 to a transverse grid wire 80, any number of metal clips 86 may be used to do so.

As shown in FIG. 2A, a pair of braces 50' extend between one of the cross rails 66 of the second base 60 and an outermost wire strut 68' of the second section 14 of the bedding foundation 10. As best illustrated in FIG. 2A, each brace 50' is a mirror image of brace 50 shown in FIG. 3. Each brace 50' has a bottom portion 52' which is pivotally secured to the cross rail 66 with staples 54 and a pair of arms 56' extending outwardly from opposed ends of the bottom portion 52' of the brace 50'. Each arm 56' terminates in an end portion 58' which comprises an arched or arcuate wire wrapped around one of the connecting portions 74 of the outermost wire strut 68'. As the bedding foundation 10 is collapsed from its erected position shown in FIG. 4 to its collapsed position shown in FIG. 5, the end portions 58' of the braces 50' slide down the connecting portions 74 of the outermost wire strut 68' until they come to rest in a substantially horizontal orientation as shown in FIG. 5.

Figure 6:
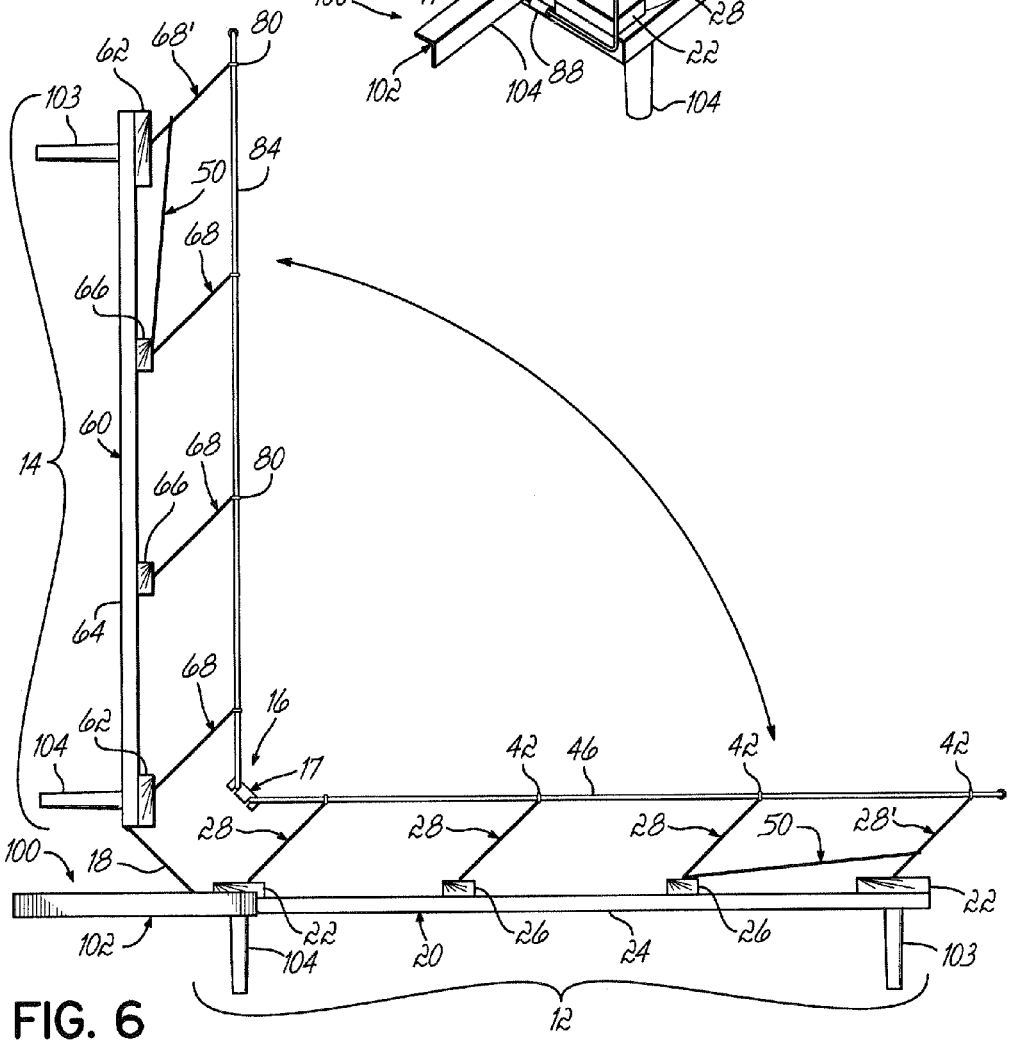
FIG. 6 is a side elevational view of the collapsible bedding foundation of FIG. 1 without a cover being collapsed.
Figure 9:
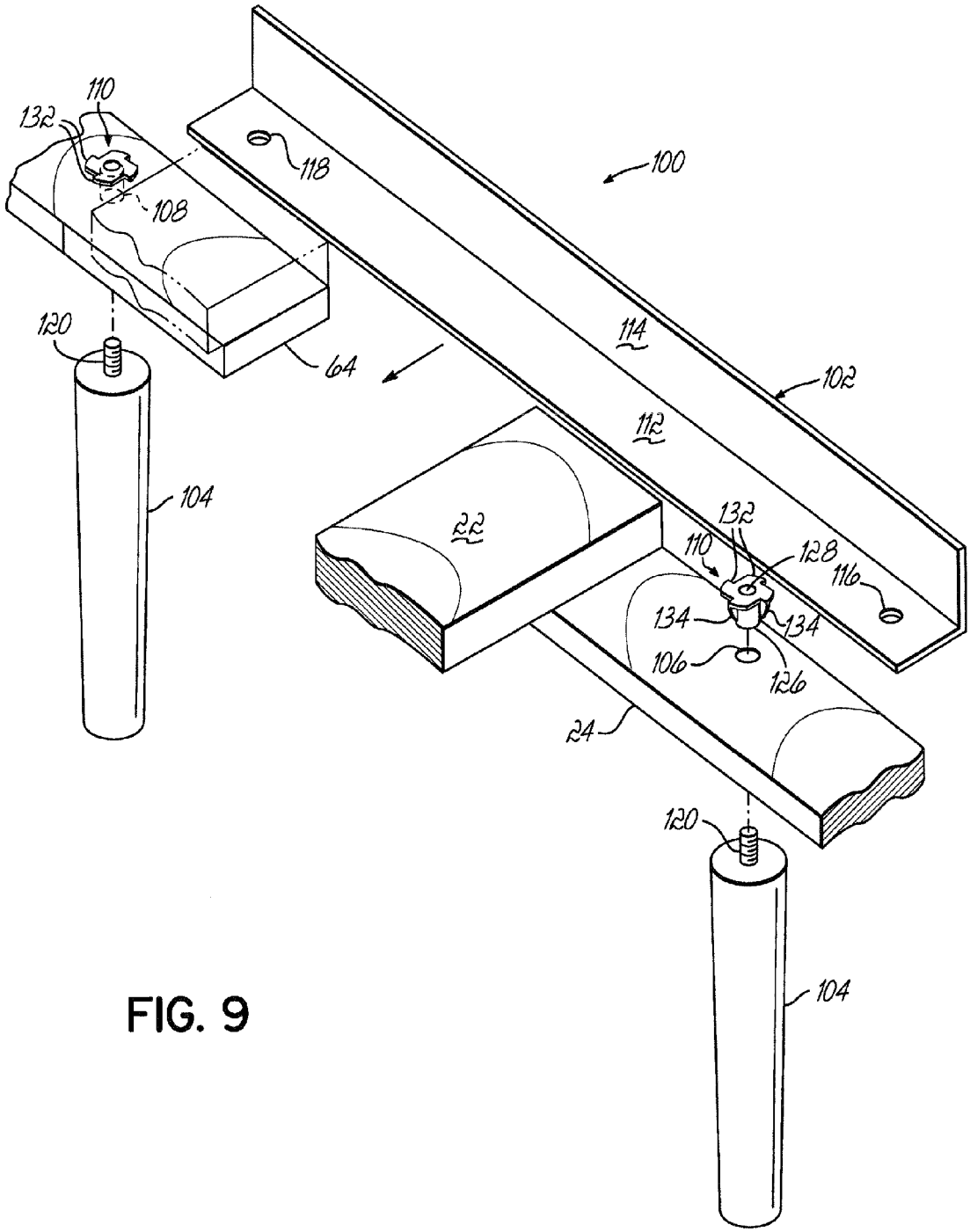
FIG. 9 is a perspective disassembled view of the support assembly of the collapsible bedding foundation of FIG. 1.

As best illustrated in FIGS. 1 and 6, the first and second sections 12, 14 of the bedding foundation 10 are connected to each other with an upper hinge 16 and a lower hinge 18. The upper hinge 16 connects the first upper grid 38 to the second upper grid 76 and more particularly connects the first border wire 46 of the first upper grid 38 to the second border wire 84 of the second upper grid 76. In the embodiment illustrated in FIG. 1, the upper hinge 16 comprises a pair of connectors 17 (only one shown in FIGS. 1 and 6) clipped onto portions of the first and second border wires 46, 84, respectively. Each connector 17 functions to space the first upper grid 38 from the second upper grid 76. Each connector 17 may be made of plastic or any other suitable material.

Figure 8:
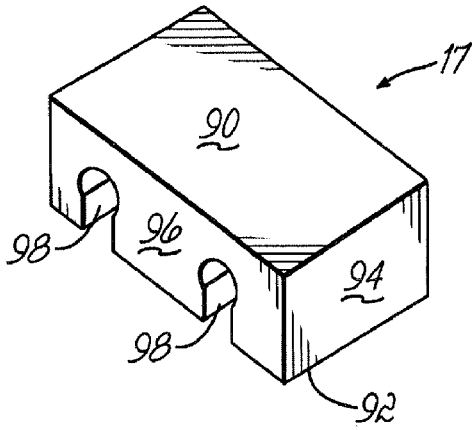
FIG. 8 is a perspective view of one of the connectors of the bedding foundation of FIG. 1.

FIG. 8 illustrates one of the connectors 17 having a top wall 90, bottom wall 92, end walls 94 and side walls 96. Two grooves 98 are formed inwardly from the bottom wall 92 and are sized to receive and retain portions of the border wires 46, 84. In accordance with the present invention, the upper hinge 16 may assume other configurations and be made of any suitable material. Although the upper hinge 16 comprises two connectors 17 in the illustrated embodiment, it may comprise any number of connectors 17.

FIGS. 1, 4, 5, and 9 illustrate the foldable bedding foundation 10 of the present invention and particularly show a support assembly 100 used to provide additional support to any area of weakness that may be present between first section 12 and second section 14 of the foldable bedding foundation 10. Although two support assemblies 100 are incorporated into a foldable bedding foundation, only one is shown in detail in FIG. 9. The other support assembly 100 (See FIG. 1) is a mirror image of the support assembly 100 shown in FIG. 9. In the illustrated embodiment, the support assembly 100 includes a bracket 102, which is associated with a plurality of legs 104, a plurality of siderail orifices 106, 108 disposed in siderails 24, 64, and a plurality of support connectors 110, such as T-nuts. These components interact with one another to provide support to the bedding foundation. See FIG. 9.

The bracket 102, in the illustrated embodiment, has an L-shaped cross-sectional configuration including a horizontal portion 112 and a vertical portion 114. The bracket 102 may be made of any material including, but not limited to, angle iron. Further, it is not necessary that the bracket 102 have an L-shaped cross-sectional configuration. For example, in an alternate embodiment, the bracket 102 might include only a horizontal portion.

In the illustrated embodiment, a plurality of bracket orifices 116, 118 are disposed through the horizontal portion 112. In particular, in the illustrated embodiment, two bracket orifices 116, 118 are disposed in the horizontal portion 112 of the bracket 102. The support assembly 100 further includes a plurality of legs 104, which, in use, are connected to the bracket 102. As can be seen in the illustrated embodiment, each leg 104 includes a threaded extension 120 adapted to be received by the bracket orifices 116, 118 in the horizontal portion 112 of the bracket 102. Additional legs 103 may be positioned at ends of the first and second sections 12, 14 distal from the support assembly 100. See FIG. 1.

As described above, the siderail orifices 106, 108 are disposed through siderails 24, 64, respectively. In particular, in the illustrated embodiment, one siderail orifice 106 is disposed through siderail 24 of the first section 12 of the foundation 10 and one siderail orifice 108 is disposed through siderail 64 of the second section 14 of the foundation 10. These siderail orifices 106, 108 are generally disposed, then, such that one siderail orifice 106 is located on one side of hinges 16, 18, and the other siderail orifice 108 is disposed on the other side of hinges 16, 18. These siderail orifices 106, 108 are adapted to substantially align with the bracket orifices 116, 118 in the horizontal portion 112 of the bracket 102.

A plurality of support connectors 110 are also included in the support assembly 100. The siderail orifices 106, 108 disposed in siderails 24, 64 are each adapted to receive one support connector 110. The support connector 110 of the illustrated embodiment is a T-nut that includes a cylindrical component 126 and a cap component 128. The cylindrical component 126 includes internal threads (not shown) to receive the threaded extension 120 of the legs 104. The cap component 128 includes a plurality of planar surfaces 132, which in the illustrated embodiment, are shaped similarly to a plurality of blades. A plurality of teeth 134 depend downwardly from these planar surfaces 132. It will be recognized by those of skill in the art that fixtures other than a T-nut may be used as the support connector 110 in the present invention.

In use, the threaded extensions 120 of the legs 104 are inserted through the bracket orifices 116, 118 located in the horizontal portion 112 of the brackets 102. This horizontal portion 112 is disposed beneath the siderails 24, 46 with the bracket orifices 116, 118 of the horizontal portion 112 of the bracket 102 substantially aligned with the siderail orifices 106, 108 in siderails 24, 64. The threaded extensions 120 of the legs 104 thus insert through the bracket orifices 116, 118 of the bracket 102 and into the cylindrical component 126 of the support connectors 110, which are disposed within the siderail orifices 106, 108 of the siderails 24, 64. By tightening the legs 104 of the support assembly 100 by rotating same, the support connector 110 of the illustrated embodiment is driven down so the teeth 134 dig down into the siderails 24, 64, to further secure the support assembly 100 to the foldable bedding foundation 10.

It will be recognized by those of skill in the art that alternative structures may be used for the support assembly 100 of the present invention. These alternative support assemblies also provide support to the foldable bedding foundation proximal to the gap between the first and second sections 12, 14. In a first alternative embodiment, the support assembly includes a first portion operatively connected to the first section, and a second portion operatively connected to the second section. These first and second portions may each be a bracket, such as an L-bracket. At least one of the first or second portions protrudes from the first or second section when the bedding foundation is in a folded position. When the bedding foundation is placed in its extended position, one of the first portion and second portion is adapted to receivingly engage the other, such that the support assembly extends between the first and second sections of the foundation.

In yet another embodiment, the support assembly may include a plurality of legs, with at least one leg operatively connected to the first section proximal to the gap, and at least one leg operatively connected to the second section proximal to the gap.

In the illustrated embodiment, in order to fold the bedding foundation, such as for shipment, one would remove one of the legs 104 from each bracket 102 (and remove those legs from the same side of the brackets). The removal of these legs 104 will disengage the bracket 102 from either siderail 24 or siderail 64. The box spring may then be folded for shipment, as described elsewhere in this application.

Figure 1A:
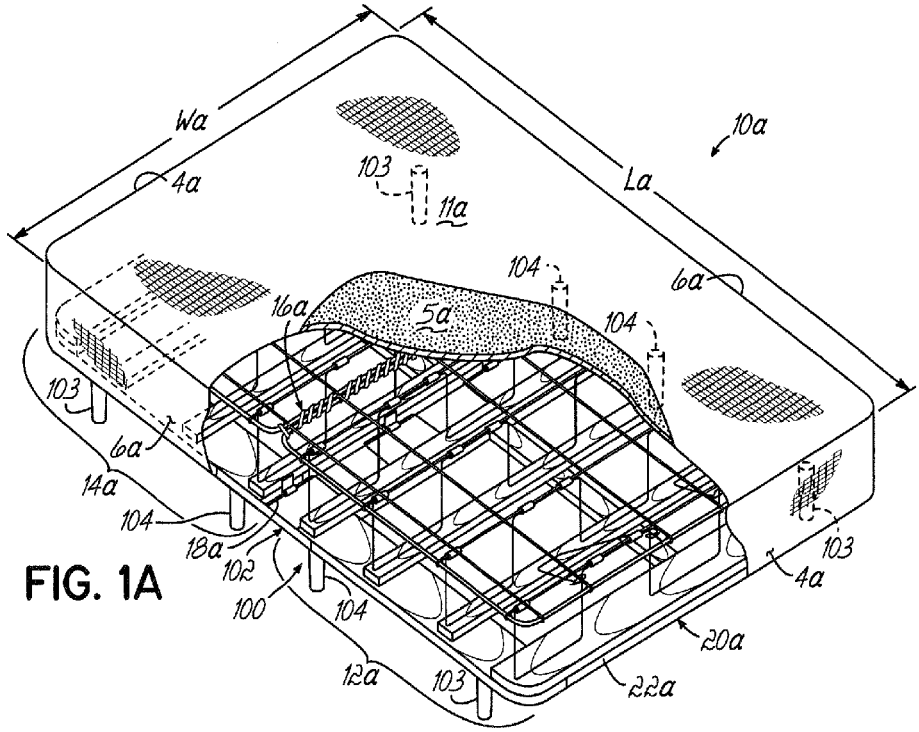
FIG. 1A is a perspective view of an alternative embodiment of the collapsible bedding foundation of the present invention in an erected condition.

FIG. 1A illustrates an alternative embodiment of collapsible bedding foundation 10*a*. The bedding foundation 10*a* has a pair of end surfaces 4*a* defining a length or longitudinal dimension La of the foundation 10*a* and a pair of opposed side surfaces 6*a* defining a width Wa of the foundation 10*a*. The bedding foundation 10*a* has a first section 12*a* hinged to a second section 14*a* with an upper hinge 16*a* and lower hinge 18*a*. The upper hinge 16*a* comprises a helical lacing member or connector made of either plastic or metal. The hinges 16*a*, 18*a* enable the bedding foundation 10*a* to move from an erected position shown in FIG. 1A to a collapsed position (not shown). The bedding foundation 10*a* may be collapsed with a surrounding cover 11*a* as shown in FIG. 1A. If desired padding 5*a* may be placed on the upper surface of the bedding product 10*a* before the surrounding cover 11*a* is attached. In all respects other than the upper hinge 16*a*, this collapsible bedding foundation 10*a* is identical to the collapsible bedding foundation 10 shown in FIG. 1.

Figure 7:
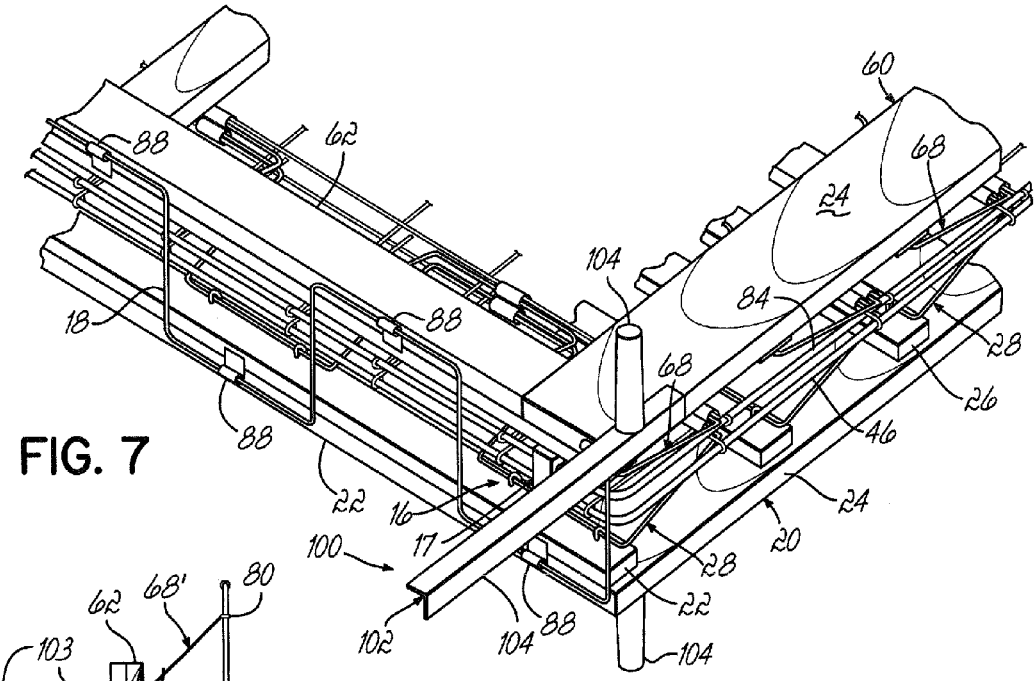
FIG. 7 is a perspective view of a portion of the bottom hinge of the bedding foundation of FIG. 1.

As best seen in FIG. 7, the lower hinge 18 connects the first base 20 to the second base 60 and more particularly connects one of the end rails 22 of the first base 20 to one of the end rails 62 of the second base 60. In one embodiment, illustrated in FIGS. 1 and 7, the lower hinge 18 comprises a wire having a square wave shape which is secured to the end rails 22, 62 of the first and second bases 20, 60, respectively with clips 88. Other means of securing the lower hinge 18 to the bases 20, 60 may be used if desired. In accordance with the present invention, the lower hinge may assume other configurations and be made of any suitable material.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art.

Therefore, the invention in its broadest aspects is not limited to the specific details shown and described. Consequently, departures may be made from the details described herein without departing from the spirit and scope of the claims which follow.

What is claimed is:

1. A foldable bedding foundation movable between a collapsed position and an erected position, said foundation comprising:

a first section having a first base comprising a pair of opposed end rails, a pair of opposed side rails and a plurality of cross rails, a first plurality of wire struts pivotally secured to said first base, a first upper wire grid pivotally secured to said first wire struts and braces extending between the first base and an outermost wire strut of the first plurality of wire struts;

a second section having a second base;

a lower hinge secured to and extending between the first and second bases; and a support assembly secured to one of said first and second bases and adapted to be secured to the other of said first and second bases and extend between the first and second bases when said bedding foundation is in an erected condition, wherein said braces are pivotally secured to one of the cross rails of said first base and have end portions which slide down the outermost wire strut of the first plurality of struts until they come to rest in a substantially horizontal orientation when the bedding foundation is collapsed from its erected position to its collapsed position.

2. The foldable bedding foundation of claim 1, further comprising a plurality of legs.

3. The foldable bedding foundation of claim 2, wherein each of said plurality of legs further comprises a threaded extension at one end of said leg and protruding therefrom substantially along the axis of symmetry of said leg.

4. The foldable bedding foundation of claim 3, further comprising a plurality of orifices in said support assembly adapted to receive said threaded extensions of said legs.

5. The foldable bedding foundation of claim 4, further comprising a first orifice in said first base and a second orifice in said second base, wherein said first and second orifices are placed so as to substantially align with said plurality of orifices in said support assembly, when said support assembly extends between the first and second bases.

6. The foldable bedding foundation of claim 5, wherein a first threaded extension of a first leg is disposed through one of said plurality of orifices of said support assembly and into said first orifice of said first base, and wherein a second threaded extension of a second leg is disposed through one of said plurality of orifices of said support assembly and into said second orifice of said second base.

7. The foldable bedding foundation of claim 6, wherein said first threaded extension and said second threaded extension are received by a first support connector and a second support connector disposed in said first orifice and said second orifice, respectively.

8. The foundation of claim 1, further comprising a second plurality of wire struts pivotally secured to said second base of said second section, a second upper wire grid pivotally secured to said second wire struts and braces extending between the second base and an outermost wire strut of the second plurality of wire struts.

9. The foundation of claim 1, wherein the lower hinge comprises a wire having a square wave shape secured to end rails of the first and second bases.

10. The foundation of claim 8, wherein the upper hinge comprises a pair of connectors clipped onto portions of border wires of the first and second upper wire grids.

11. A foldable bedding foundation movable between a collapsed position and an erected position, said foundation comprising:

a first section having a first base, a first plurality of wire struts pivotally secured to said first base of said first section, and a first upper wire grid pivotally secured to said first wire struts;

a second section having a second base, a second plurality of wire struts pivotally secured to said second base of said second section, and a second upper wire grid pivotally secured to said second wire struts;

a lower hinge secured to and extending between the first and second bases;

an upper hinge secured to and extending between the first and second upper wire grids;

a plurality of braces pivotally secured to each of the first and second bases and slidably engaged with wire struts of the first and second sections of the bedding foundation furthest from said hinges wherein said bedding foundation may be collapsed only when said braces are lowered; and a support assembly adapted to be secured to and extend between the first and second bases.

12. The foldable bedding foundation of claim 11, further comprising a plurality of legs.

13. The foldable bedding foundation of claim 12, wherein each of said plurality of legs further comprises a threaded extension at one end of said leg and protruding therefrom substantially along the axis of symmetry of said leg.

14. The foldable bedding foundation of claim 13, further comprising a plurality of orifices in said support assembly adapted to receive said threaded extensions of said legs.

15. The foldable bedding foundation of claim 14, further comprising a first orifice in said first base and a second orifice in said second base, wherein said first and second orifices are placed so as to substantially align with said plurality of orifices in said support assembly, when said support assembly extends between the first and second bases.

16. The foldable bedding foundation of claim 15, wherein a first threaded extension of a first leg is disposed through one of said plurality of orifices of said support assembly and into said first orifice of said first base, and wherein a second threaded extension of a second leg is disposed through one of said plurality of orifices of said support assembly and into said second orifice of said second base.

17. The foldable bedding foundation of claim 16, wherein said first threaded extension and said second threaded extension are received by a first support connector and a second support connector disposed in said first orifice and said second orifice, respectively.

18. A foldable bedding foundation comprising:

a first section having a first base including a plurality of cross rails, a first plurality of wire struts pivotally secured to said first base of said first section, and a first upper wire grid pivotally secured to said first wire struts;

a second section having a second base including a plurality of cross rails, a second plurality of wire struts pivotally secured to said second base of said second section, and a second upper wire grid pivotally secured to said second wire struts;

a lower hinge secured to and extending between the first and second bases;

an upper hinge secured to and extending between the first and second upper wire grids;

braces having bottom portions pivotally secured to the cross rails of the first and second bases and having end portions slidably engaged with wire struts of the first and second sections of the bedding foundation furthest from said upper and lower hinges; and a support assembly secured to one of said bases and adapted to extend between the first and second bases when said bedding foundation is in an erected condition.

19. The foundation of claim 18, wherein the first and second bases are made of wood.

* * * * *